United States Patent [19]

Tilbor

[11] 4,382,599

[45] May 10, 1983

[54] TOY VEHICLE GAME

[75] Inventor: Neil Tilbor, Fresh Meadows, N.Y.

[73] Assignee: Ideal Toy Corporation, Hollis, N.Y.

[21] Appl. No.: 206,756

[22] Filed: Nov. 14, 1980

[51] Int. Cl.[3] ..... A63F 9/14; A63H 18/12

[52] U.S. Cl. ..... 273/86 B; 46/1 K; 46/262

[58] Field of Search ..... 273/86 B; 46/1 K, 258, 46/260, 261, 262; 104/60, 295, 296, 304, 305

[56] References Cited

U.S. PATENT DOCUMENTS

| | | | |
|---|---|---|---|
| 2,952,942 | 9/1960 | Troha | 273/86 B X |
| 3,467,311 | 9/1969 | Ernst | 273/86 B |
| 4,078,799 | 3/1978 | Lahr | 273/86 B |
| 4,247,107 | 1/1981 | Smith et al. | 273/86 B |

FOREIGN PATENT DOCUMENTS

| | | | |
|---|---|---|---|
| 503477 | 4/1939 | United Kingdom | 273/86 B |

*Primary Examiner*—Anton O. Oechsle
*Attorney, Agent, or Firm*—Richard M. Rabkin

[57] ABSTRACT

A slotless toy vehicle game in which controllable toy vehicles can change lanes in substantially any location along the track includes a track section defining a portion of the pair of the lanes and having an obstruction wall between the lanes preventing the controllable vehicles from switching lanes in that track section. Current is supplied to power the controllable toy vehicles through current supply strips in the lanes, but current flow in the strips of the track section can be selectively interrupted so that the vehicles must be steered into the powered lane in order to pass through the track section. Indicating lights or the like are provided to warn the player as to which lane has power supplied to it interrupted.

8 Claims, 7 Drawing Figures

TOY VEHICLE GAME

The present invention relates to toy vehicle games, and, more in particular, to a game having a track section in which the current supply to the lanes is alternately interrupted.

In recent years, a number of "slotless" toy vehicles games have been developed by various manufacturers. One such game is disclosed, for example, in U.S. Pat. No. 4,078,799, the disclosure of which is incorporated herein by reference. Slotless racing games of this type have been found to be highly popular due to the fact that the toy vehicles in the game can be controlled at substantially any point along the track to transfer or switch from one lane to the other. That is, in effect, the vehicles are remotely steered by the players in order to pass one another or pass a drone car traveling with the controllable vehicles along the track.

It is an object of the present invention to provide a slotless toy vehicle game in which the players must control their toy vehicles upon entering a track section to move in one or the other of the track lanes in order that the vehicle continues to move along the track.

Another object of the present invention is to provide a toy vehicle game in which the players must make lane changing decisions during each lap of the game.

A further object of the present invention is to provide a "slotless" toy vehicle game in which current to a portion of the track is interrupted so that the players must control their respective toy vehicles to avoid that lane during play of the game.

In accordance with an aspect of the present invention, a toy vehicle game is provided having a flat slotless track defining at least two vehicle lanes permitting controllable toy vehicles to move along the track surface in two generally parallel paths of travel. The controllable toy vehicles include an electric motor and means for causing the vehicle to switch from one lane to the other. Current is supplied to the toy vehicles in each lane of the track through a pair of current supply strips and a ground strip, as described in the above noted patent. Operator operable control means are used to control the supply of current to the motor and for actuating the means that causes the vehicles to switch lanes.

The track of the game includes a track section defining a continuation of the two track lanes, and having a barrier wall between the lanes. This wall prevents the controllable toy vehicles from changing lanes in that track section. The electrical supply system for the game includes means for interrupting current supply to the toy vehicles in one or the other of the lanes of the track section, without effecting current supply in the remainder of the track. In addition, an indicating light system or the like can be provided for the players to warn the players as to which lane is not powered in the track section. With this arrangement, the players must control movement of their vehicles along the track so that their vehicles enter the lane to which power is supplied and avoid the unpowered lane in order to keep their vehicles moving in the simulated race. If the vehicle is not controlled to enter the track section properly, it will pass onto the lane to which power is not supplied, and will come to a halt or slow down substantially. An increased degree of difficulty is provided by alternately interrupting current in each of the lanes, so that the toy vehicles must be carefully controlled during their movement along the track.

The above and other objects, features and advantages of this invention will be apparent in the following description of an illustrative embodiment thereof, which is meant to be read in connection with the accompanying drawings, wherein.

Figure 1:
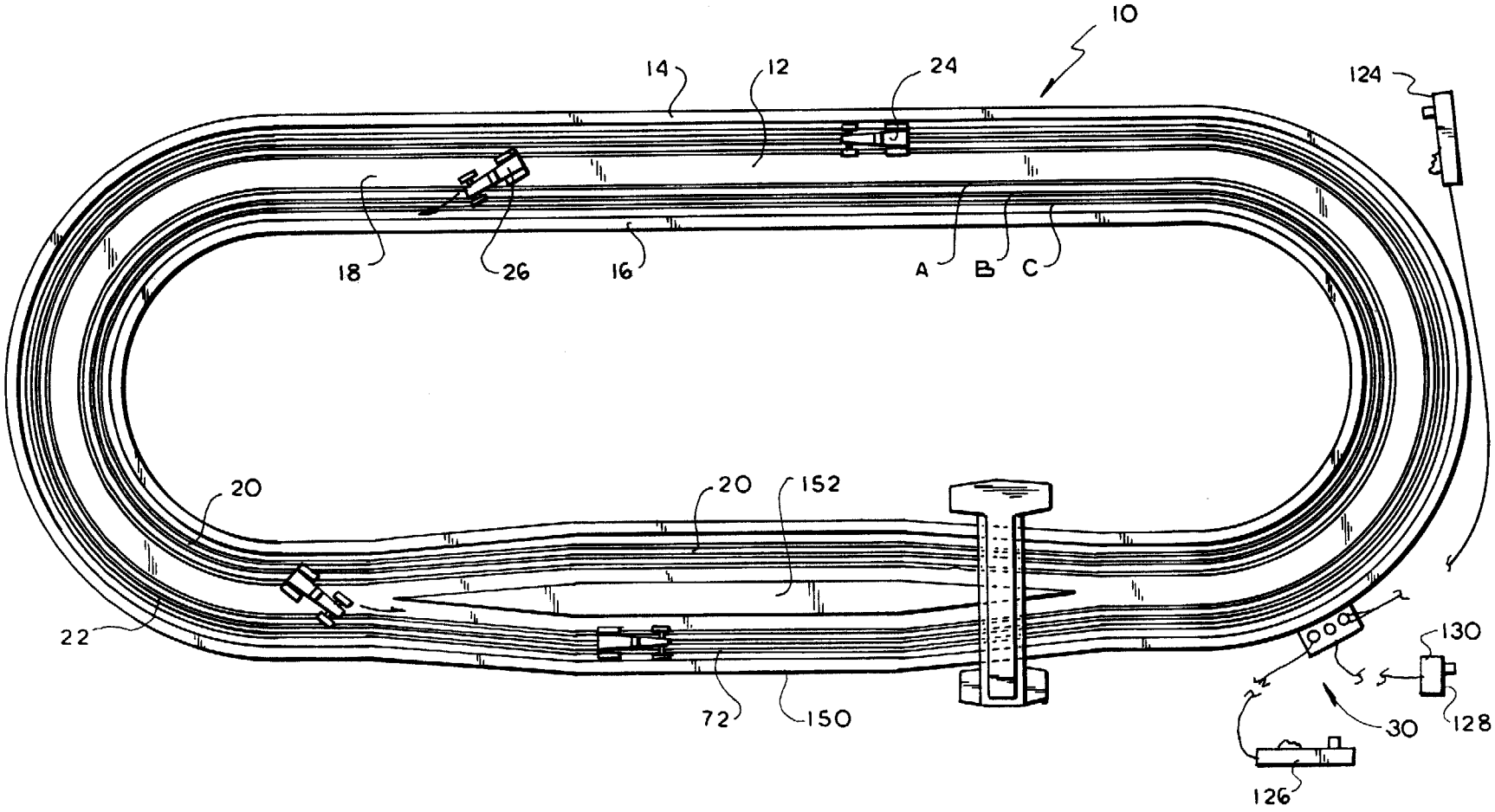
FIG. 1 is a plan view of a toy vehicle game constructed in accordance with the present invention.

Referring now to the drawings in detail, and initially to FIG. 1 thereof, a toy vehicle game toy 10 constructed in accordance with the present invention includes an endless plastic track 12 having a pair of laterally spaced upstanding sidewalls 14, 16 and a roadbed or tread surface 18 extending therebetween. The roadbed has a width sufficient to define at least two vehicle lanes 20, 22 thereon along which a plurality of toy vehicles can be operated.

In the illustrative embodiment of the invention the toy vehicle game includes operator controlled vehicles 24, 26 which are adapted to change lanes at the command of the operator. These vehicles are separately controlled by the players through a control system 30 which enables the players to vary the amount of current supplied to the electric motors in the vehicles, thereby to vary the vehicle speed. The controls also enable the players to change the polarity of current supplied to the respective vehicle motors whereby the vehicles can be switched by the players from one lane to the other.

Control system 30, track 12 and toy vehicles 24, 26 are of the type presently manufactured and sold by the Ideal Toy Corporation under the trademarks "TCR" and "Total Control Racing." The control system and the toy vehicles themselves are described in detail in U.S. Pat. No. 4,078,799.

Figures 2, 3:
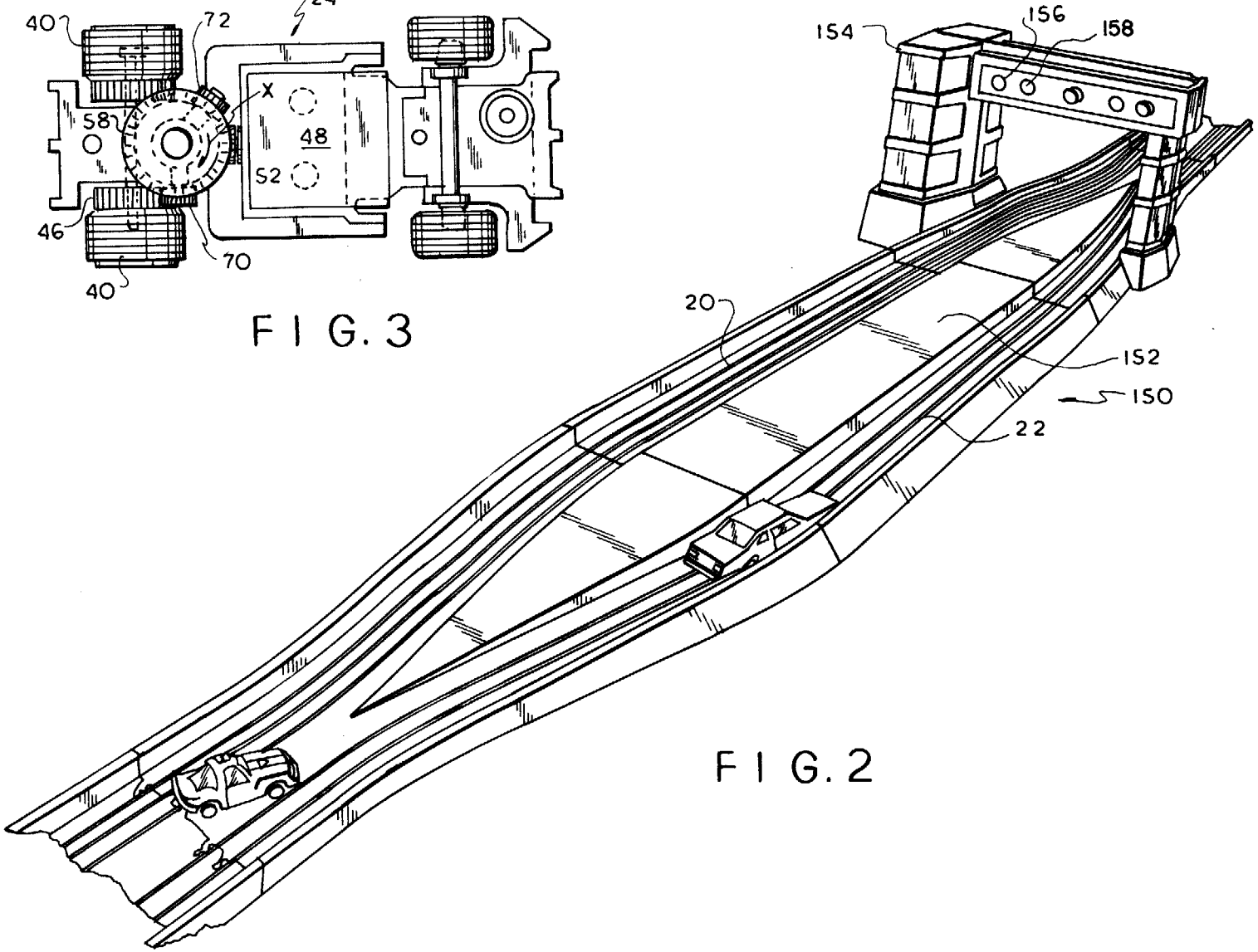
FIG. 2 is a perspective view on a larger scale of the track section in which current supply to the track lanes is alternately interrupted.
FIG. 3 is a top plan view of a controllable toy vehicle adapted for use in the game of the invention.

One of the controllable toy vehicles, 24, is illustrated in FIG. 3. These vehicles are responsive to current polarity reversal to selectively drive one or the other of the rear wheels 40 of the vehicle and thereby bias the vehicle into one or the other of the lanes 20, 22 of the track. In the illustrative embodiment of the invention, the toy vehicle includes an electric motor 48 having an output shaft to which a spur gear 52 is secured for rotation by the motor. The spur gear drives a crown gear 58 rotatably mounted on a central pin or post 64. A collar 62 also rotatably mounted on the pin carries a pair of angularly related spur gears 70, 74 drivingly engaged with crown gear 58. As described in U.S. Pat. No. 4,078,799, rotation of the motor output gear 52 in one or the other direction, depending upon the polarity of current supplied to the motor, will cause one of the gears 70, 72 to engage drive gear 46 associated with one or the other of the rear wheels 40. When one of the rear wheels is driven, the other wheel will, essentially, freewheel so that a biasing force is applied to the toy vehicle causing it to move from one lane to the other.

Electric current is supplied to the motor of the toy vehicle through current supply strips A, B and C located in each of the track lanes. The C strips are connected to electrical ground and the A and B strips are provided to separately supply current and control polarity of the current to the respective controllable vehicles so that the two controllable toy vehicles can operate in the same lane and still be separately controlled.

Figure 4:
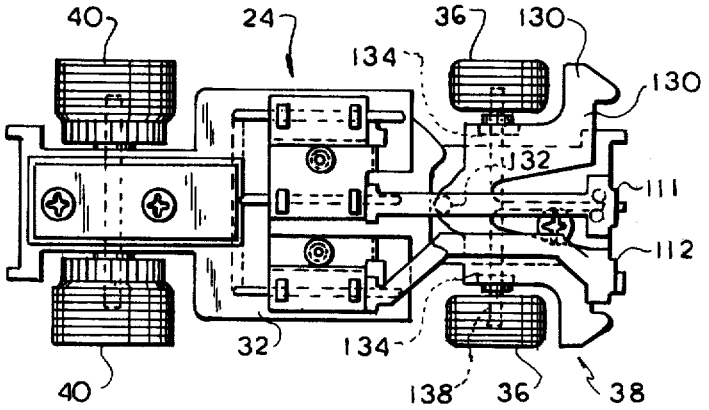
FIG. 4 is a bottom view of the toy vehicle shown in FIG. 3.

As described in U.S. Pat. No. 4,078,799, current collectors provided on the toy vehicles are arranged so that one of the toy vehicles collects current from supply strips A and the other toy vehicle collects current from supply strips B. For example, as illustrated in FIG. 4, vehicle 24 is provided with two current collectors 111 and 112, with the current collector 112 positioned to contact ground strip C and collector 111 positioned to contact strip B. Vehicle 26 on the other hand will have corresponding current collectors with its current collector 112 located in the same position as the corresponding collector of vehicle 24 to contact ground strip C, but with its other current collector positioned to contact current supply strip A. These current collectors are mounted on the vehicle in any convenient manner known in the art and are electrically connected in a known manner to motor 48 of their respective vehicles. Current collector 111 of vehicle 24 is mounted on the vehicle to engage contact strips B regardless of which lane the vehicle is in. This current collector is located centrally of the vehicle frame. On the other hand, the corresponding current collector of vehicle 26 will be located off-center from the center line of the vehicle in spaced relation to its associated current collector 112. This current collector is positioned to engage contact strips A regardless of the lane in which the vehicle is moving. By this arrangement each of the operators can selectively control current supply and polarity to contact strips A, B to control a respective one of the vehicles 24, 26 regardless of the lane occupied by the vehicle.

Figure 6:
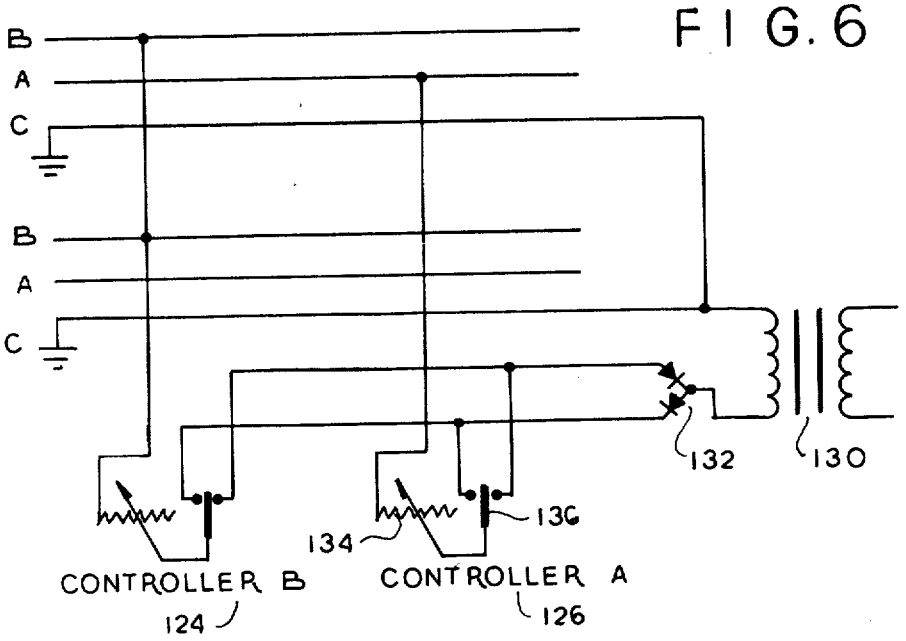
FIG. 6 is a schematic circuit diagram of the electrical control system used for the toy vehicle game of FIG. 1.

The control system for the toy vehicle game includes respective controllers 124, 126 by which the players control the toy vehicles 24, 26 respectively. The control system includes a plug 128 by which the system is connected to an electrical AC power source and a transformer 130 built into the plug. Power is supplied from transformer 130 through a half wave rectifier 132 including two diodes connected as shown in FIG. 6 to separately supply current to controllers 124, 126. Each controller is provided as a hand-held unit and includes a variable resistor 134 operated as a trigger on the unit, as well as a single pole double throw switch 136. Current from collector 124 is supplied through its variable resistor 134 to the contact strips B and current from controller 126 is supplied through its variable resistor to contact strips A.

The polarity of the current supplied to the toy vehicles is separately and independently controlled by switches 136 so that the polarity of current supplied to the motors 48 of the respective vehicles, as controlled by the respective controllers, will vary in accordance with the position in which the switches 136 are placed. By this arrangement using his controller, a player can control the speed of his vehicle along track 12 and he can also variably position his vehicle along the track simply by changing the polarity of current supplied to the vehicle.

As illustrated in FIG. 1, when it is desired to switch a vehicle from the outer lane to the inner lane, as shown occurring with vehicle 26, the polarity of current supplied to the vehicle is selected to drive the outer or right wheel of the vehicle thereby moving the vehicle leftwardly into the inner lane. Likewise, when it is desired to move the vehicle outwardly the inner or left wheel of the vehicle is driven by properly selecting the polarity of current supplied to the motor of the vehicles so that the vehicle will move toward the right and into the outer lane.

In accordance with the present invention, an added degree of difficulty is provided in the game by the provision of a track section which requires the players to make a decision upon approaching the track section as to which lane therein the players' vehicle will pass through. This track section 150, as illustrated in FIG. 1, includes the lanes 20, 22 and current supply strips A, B and C. In addition, track section 150 includes a central wall 152 which will prevent the players from steering their toy vehicle from one lane to the other in the track section.

Figure 7:
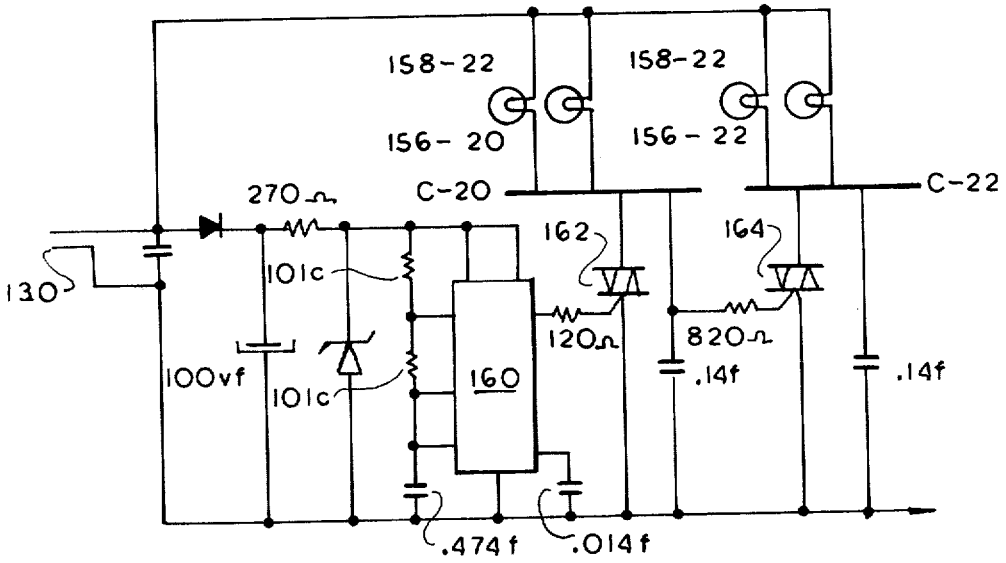
FIG. 7 is a schematic circuit diagram of the electrical system used to alternately interrupt current supply in the lanes of the novel track section of the invention.

A current control circuit, illustrated in FIG. 7, is provided for track section 150 which will selectively interrupt current supply to one or the other of the lanes in that track section so that a vehicle passing into a lane to which power has been interrupted will slow down and/or come to a halt, while a vehicle in the other lane of track section 150 will pass therethrough under full power. A bridge 154 is provided in conjunction with track section 150 and has indicating lights 156, 158 for each lane (light 156 is red and light 158 is green) to provide an indication as to which lane has power supplied and which has power cut off. With this arrangement, as a player's toy vehicle approaches track section 150 he must make a determination as to which lane in the track section he will permit his vehicle to pass through. He must time his approach and passage through the lane in such a manner that his toy vehicle passes through the lane before power supplied to that lane is cut off.

Figure 5:
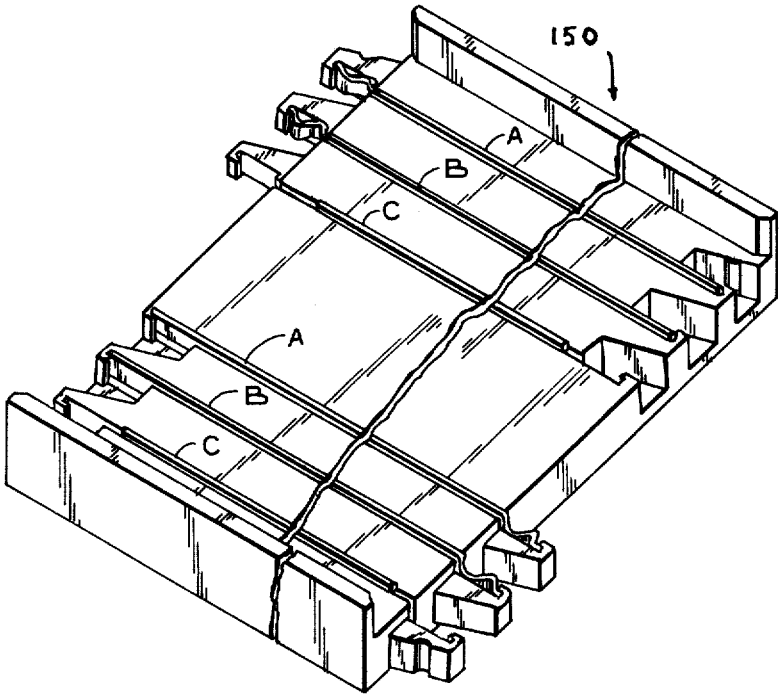
FIG. 5 is a perspective view of one end of the track section showing the electrical isolation of the ground strips in the adjacent lane.

The ends of track section 150 are formed in accordance with the teachings of U.S. Pat. No. 4,106,695 to mate with and connect to the remainder of the track sections of the Total Control Racing game. However, in accordance with the electrical control circuit features used to alternately cut off supply of current to the lanes of this track section, the ends of the ground stripcs C at both ends of track section 150 are terminated short of the ends of the track section, as shown in FIG. 5, so that when two track sections are mated there is no contact between the ground strips C of the track section 150 and the ground strips C of the remainder of the track. Thus, ground strips C in track section 150 are isolated from the ground strips in the remainder of the track. This permits the connection between the ground strips C of section 150 and ground to be selectively opened, to prevent flow of current through the vehicle's motor to ground from the power supply circuit, thereby interrupting current flow to the motor of the toy vehicle in a particular lane.

The control circuit for track section 150 is illustrated in FIG. 7. As seen therein, power is supplied to the control circuit from transformer 130, to an astable multivibrator 160 which drives a first triac 162 which, when turned off, opens the connection to the common rail C in lane 20. If that rail is open, or off, then neither car can pass through lane 20. When triac 162 is energized for lane 20, the green light 156-20 is illuminated as is the red light 158-22 for lane 22.

A second triac 164 is also connected in the circuit so that it receives current through lamps 156-20 and 158-22 when the common rail in lane 20 is energized. This turns the second triac 164 off, thus turning off the common rail in lane 22. Thus, when triac 162 is turned off, triac 164 is turned on. This closes the circuit to the common rail C in lane 22 and illuminates the green light 156-22 for lane 22 and the red light 158-20 for lane 20.

Preferably the multivibrator has an operating cycle of seven to eight seconds which provides a sufficient amount of time for a vehicle to pass through the lane under full power.

Although a specific type of electronic circuit has been described in detail with reference to the accompanying drawings, it will be appreciated that other electromechanical type of timing mechanisms can be used to achieve substantially the same results.

Accordingly, it is seen that a toy vehicle game is provided within which an increased degree of control and dexterity is required on the part of the players during the course of the game. Substantial time can be lost by the players in passing through the disconnected or dead lane of the track section 150, while a substantial advantage can be gained by the other player in passing through the track section under full power. Thus, the players when approaching the track section 150 must determine which lane to steer his toy vehicle in. That is, regardless of the lane in which the vehicle is located as it approaches 150, the player must determine whether to steer his vehicle into the other lane, in order to pass through the track section 150 under full power.

Although an illustrative embodiment of the invention has been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. A toy vehicle game including a relatively flat slotless track defining a pair of lanes along the track length, at least one controllable electrical toy vehicle for use on the track, player operable means for causing said controllable vehicle to switch lanes and move at variable speeds along the track; and means in said track lanes for supplying current to said vehicle; said track including a track section comprising a continuation of said pair of lanes; and means for alternately interrupting the supply of current to the lanes of said track section while providing an indication as to which lane no current is supplied, whereby a player must control his controllable vehicle to enter the lane of said track section to which current is supplied.

2. A toy vehicle game as defined in claim 1 wherein said means for supplying current to the vehicle includes a plurality of electrically conductive contact strips in each lane being electrically connected to a correspondingly positioned strip in the other lane to define electrically connected pairs of strips, with one of said pairs of strips being connected to electrical ground; the ground strips in said track section being insulated from the ground strips in the remainder of said track; and said means for alternately interrupting the supply of current comprising means for opening the connection of said ground strips in said track section.

3. A toy vehicle game as defined in claim 1 wherein said track section has an obstruction between the lanes therein for preventing the controllable vehicle from switching lanes in said track section.

4. A toy vehicle game comprising a flat slotless track defining at least two vehicle lanes permitting toy vehicles to move along the track surface in two generally parallel paths of travel, at least one controllable toy vehicle including an electric motor and means for causing the vehicle to switch from one lane to the other; current supply means in each lane of the track for supplying current to said motor, and operator operable control means for controlling the supply of current to said motor and actuating said means for causing the vehicle to switch lanes; said current supply means including at least three electrically conductive strips extending along each of said lanes, including a ground contact strip and two electrical supply control strips, and said toy vehicle including current collector means for contacting said ground strip and one of said supply strips to supply current to its electric motor; said track including a track section having means for interrupting current supply to the toy vehicle motor in one or the other of the lanes in said track section without affecting current supply in the remainder of said track; said current supply and ground strips in each of said lanes being in the same relative positions with each of said supply strips in each lane being electrically connected to the corresponding supply strip in the other lane whereby two controllable toy vehicles may be separately controlled in either of said lanes; the ground strips in said track section being electrically insulated from the ground strips in the remainder of said track and said interrupting means comprising means for opening the connection of the ground. strips in the track section with ground.

5. A toy vehicle game as defined in claim 4 wherein said opening means comprises means for alternately opening the connections between the ground strips in said track section and ground whereby the vehicles will be supplied with current in one of said lanes in the track section.

6. A toy vehicle game as defined in claim 5 including means for indicating to the player which lane in the track section is capable of supplying current to the toy vehicle.

7. A toy vehicle game as defined in claim 6 wherein said opening means includes a pair of TRIACS respectively connected to the ground strips in said track section.

8. A toy vehicle game as defined in claim 4 wherein said track section includes a barrier wall between said lanes preventing said controllable toy vehicle from changing lanes in said track section.

* * * * *